US009408445B2

(12) United States Patent
Mogil et al.

(10) Patent No.: US 9,408,445 B2
(45) Date of Patent: Aug. 9, 2016

(54) SOFT-SIDED INSULATED CONTAINER WITH INFLATABLE WALL STRUCTURE

(71) Applicants: Melvin S. Mogil, Toronto (CA); Rick Stephens, Chicago, IL (US); Ryan Mather, Boulder, CO (US)

(72) Inventors: Melvin S. Mogil, Toronto (CA); Rick Stephens, Chicago, IL (US); Ryan Mather, Boulder, CO (US)

(73) Assignee: CALIFORNIA INNOVATIONS INC. (CA)

( * ) Notice: Subject to any disclaimer, the term of this patent is extended or adjusted under 35 U.S.C. 154(b) by 20 days.

(21) Appl. No.: 13/782,489

(22) Filed: Mar. 1, 2013

(65) Prior Publication Data

US 2014/0248003 A1 Sep. 4, 2014

(51) Int. Cl.

| | |
|---|---|
| ***B65D 81/38*** | (2006.01) |
| ***A45C 3/00*** | (2006.01) |
| ***A45C 3/04*** | (2006.01) |
| ***A45C 7/00*** | (2006.01) |
| ***A45C 11/20*** | (2006.01) |

(52) U.S. Cl.

CPC . *A45C 3/001* (2013.01); *A45C 3/04* (2013.01); *A45C 7/0081* (2013.01); *A45C 11/20* (2013.01)

(58) Field of Classification Search

CPC ..... B65D 81/3897; B65D 88/1681; B65D 81/051; B65D 81/052; A45C 11/20; A45C 7/0077; A45C 7/0081

USPC ..... 383/110, 3, 111, 109, 2; 206/522

See application file for complete search history.

(56) References Cited

U.S. PATENT DOCUMENTS

| | | | | | |
|---|---|---|---|---|---|
| 1,372,893 | A | | 3/1921 | Miller | |
| 2,770,275 | A | | 11/1956 | Suciu | |
| 3,031,121 | A | * | 4/1962 | Chase | 383/13 |
| 3,339,823 | A | * | 9/1967 | Bessermann-Nielsen | 383/15 |
| 3,587,794 | A | | 6/1971 | Mattei | |
| 3,730,240 | A | * | 5/1973 | Presnick | 383/3 |
| 4,085,785 | A | | 4/1978 | Hoot | |
| 4,091,852 | A | | 5/1978 | Jordan et al. | |
| 4,172,152 | A | * | 10/1979 | Carlisle | 426/127 |
| 4,211,091 | A | * | 7/1980 | Campbell | 62/372 |
| 4,387,846 | A | * | 6/1983 | DuCorday | 383/15 |
| 4,679,242 | A | * | 7/1987 | Brockhaus | 383/4 |
| 4,707,883 | A | * | 11/1987 | Irani et al. | 16/407 |
| D328,550 | S | | 8/1992 | Mogil | |
| D340,387 | S | | 10/1993 | Melk | |
| D340,621 | S | | 10/1993 | Melk | |
| D340,840 | S | | 11/1993 | Melk | |
| 5,346,309 | A | * | 9/1994 | Book | 383/4 |
| 5,354,131 | A | | 10/1994 | Mogil | |
| 5,403,095 | A | | 4/1995 | Melk | |

(Continued)

FOREIGN PATENT DOCUMENTS

CA 2149491 A1 11/1996

*Primary Examiner* — Jes F Pascua

(74) *Attorney, Agent, or Firm* — Ostrolenk Faber LLP

(57) ABSTRACT

A soft-sided insulated container assembly is made of a flexible wall structure that is movable between a collapsed position and a deployed position. In one variation of the deployed position it resembles a tote-bag; in another variation of folding the deployed position corresponds to a generally box-like shape. The container includes a self-inflating wall structure that has an inner layer or skin, an outer layer or skin, and a resilient, open-cell insulating layer trapped between the two skins. A valve governs the ability to take in or to expel air. The outer layer may be thicker and more robust that the inner layer, the better to resist abrasion or punctures. The inner layer may be reflective. There may be a removable internal liner. That liner may be transparent.

20 Claims, 6 Drawing Sheets

(56) References Cited

U.S. PATENT DOCUMENTS

| | | | | |
|---|---|---|---|---|
| 5,490,396 | A * | 2/1996 | Morris | 62/457.2 |
| D371,052 | S | 6/1996 | Melk | |
| D373,514 | S | 9/1996 | Melk | |
| D373,515 | S | 9/1996 | Melk | |
| D382,771 | S | 8/1997 | Mogil | |
| D382,772 | S | 8/1997 | Mogil | |
| D387,249 | S | 12/1997 | Mogil | |
| D391,121 | S | 2/1998 | Melk | |
| D394,552 | S | 5/1998 | Melk | |
| D408,225 | S | 4/1999 | Hodash | |
| 5,915,580 | A | 6/1999 | Melk | |
| 5,924,303 | A | 7/1999 | Hodosh | |
| D419,770 | S | 2/2000 | Mogil | |
| D419,830 | S | 2/2000 | Birutis et al. | |
| D421,366 | S | 3/2000 | Mogil | |
| 6,067,816 | A | 5/2000 | Hodosh | |
| 6,068,402 | A | 5/2000 | Freese et al. | |
| 6,092,661 | A | 7/2000 | Mogil | |
| 6,116,045 | A | 9/2000 | Hodosh | |
| D435,342 | S | 12/2000 | Mogil | |
| D435,968 | S | 1/2001 | Mogil | |
| D436,442 | S | 1/2001 | Mogil | |
| 6,234,677 | B1 | 5/2001 | Mogil | |
| 6,237,776 | B1 | 5/2001 | Mogil | |
| 6,238,091 | B1 | 5/2001 | Mogil | |
| 6,247,328 | B1 | 6/2001 | Mogil | |
| D452,075 | S | 12/2001 | Mogil | |
| D453,625 | S | 2/2002 | Mogil | |
| 6,363,739 | B1 | 4/2002 | Hodosh et al. | |
| 6,390,345 | B1 | 5/2002 | Brown et al. | |
| 6,439,389 | B1 | 8/2002 | Mogil | |
| 6,481,239 | B2 | 11/2002 | Hodosh et al. | |
| 6,513,661 | B1 | 2/2003 | Mogil | |
| 6,582,124 | B2 | 6/2003 | Mogil | |
| 6,644,063 | B2 | 11/2003 | Mogil | |
| 6,821,019 | B2 | 11/2004 | Mogil | |
| 7,162,890 | B2 | 1/2007 | Mogil et al. | |
| 7,669,436 | B2 | 3/2010 | Mogil et al. | |
| 7,682,080 | B2 * | 3/2010 | Mogil | 383/110 |
| 7,757,878 | B2 | 7/2010 | Mogil et al. | |
| 7,841,207 | B2 | 11/2010 | Mogil et al. | |
| 8,043,004 | B2 | 10/2011 | Mogil | |
| 8,096,442 | B2 | 1/2012 | Ramundi | |
| 8,993,079 | B1 * | 3/2015 | Duong | 428/35.3 |
| 2003/0024960 | A1 | 2/2003 | Greenstein et al. | |
| 2004/0035143 | A1 | 2/2004 | Mogil | |
| 2005/0117817 | A1 | 6/2005 | Mogil et al. | |
| 2005/0205459 | A1 | 9/2005 | Mogil et al. | |
| 2007/0237432 | A1 | 10/2007 | Mogil | |
| 2008/0260303 | A1 * | 10/2008 | De Lesseux et al. | 383/110 |
| 2009/0095757 | A1 | 4/2009 | Ramundi | |
| 2010/0116830 | A1 | 5/2010 | Mogil et al. | |
| 2010/0282763 | A1 | 11/2010 | Mogil et al. | |
| 2011/0127274 | A1 | 6/2011 | Mogil | |
| 2012/0243808 | A1 * | 9/2012 | de Lesseux et al. | 383/110 |

* cited by examiner

SOFT-SIDED INSULATED CONTAINER WITH INFLATABLE WALL STRUCTURE

FIELD OF THE INVENTION

This invention relates to the field of insulated containers.

BACKGROUND OF THE INVENTION

Insulated containers have become popular for carrying either articles that may best be served cool, such as beverages or salads, or warm, such as appetizers, hot dogs, and so on. Such containers are frequently used to carry liquids, whether hot liquids, such as soup containers, coffee or tea, or cold liquids such as beer, soft drinks, or other carbonated beverages, juices and milk. Sometimes these containers may by used to carry lunches, which may include a sandwich, fruit, carrot and celery sticks, a drink, cookies, and so on.

Portable insulated containers tend to be of two types: hard-sided insulated containers or soft-sided insulated containers. Hard-sided portable insulated containers tend to be made of moulded plastic, with an inner layer, or wall, and an outer layer or wall, with an insulation space (which may be an air-space) therebetween. Hard-sided portable insulated containers are, as might be understood by the name, substantially rigid. The adjective "portable" is sometimes generous, as a full cooler capable of carrying 24 cans at 385 mL each, plus ice, may have significant weight. Hard-sided coolers, by their nature, may tend to be bulky, and, even when provided with a handle on top or handles at the ends may tend not to be particularly convenient to carry. A user's perception of the convenience of their portability may diminish with each additional step.

A soft-sided cooler, by contrast, relies on external insulated wall structure that is not substantially rigid. In some instances the external insulated wall structure may be foldable between collapsed and expanded conditions. The insulated wall structure may typically include an outside layer of webbing or fabric, an inside layer of webbing or fabric, and a layer of flexible insulation positioned between the inner and outer layers. Soft-sided coolers may sometimes include substantially rigid liners to assist in permitting the cooler to maintain a given shape, or to protect items inside the cooler from being crushed.

SUMMARY OF THE INVENTION

In an aspect of the invention there is a soft-sided insulated container having an inflatable wall structure.

In a feature of that aspect of the invention, the container is movable between a collapsed position and a deployed position. In another feature, the container has an outlet by which to permit the inflatable wall structure to be deflated. In a further feature, when the wall structure is deflated the container is movable to a rolled-up position. In still another feature the inflatable wall structure, when inflated, forms a peripheral wall having an insulated chamber defined therewithin. In still another feature, the inflatable wall structure is self-inflating. In another feature, the inflatable wall structure includes an open cell foam captured therewithin. In yet another feature the inflatable wall structure is movable to either of (a) a tote-shaped container; and (b) a cubic container. In still another feature, the container has a washable liner. In a further feature, the liner is at least one of (a) removable; and (b) transparent.

In another feature, the inflatable wall structure, when inflated, forms a peripheral wall defining an insulated chamber in which to place objects. The inflatable will structure has an outer membrane, an inner membrane, and a layer of insulation trapped between the outer membrane and the inner membrane. In another feature, the layer of insulation includes a resilient open-celled foam. In still another feature, the inflatable wall structure includes a valve operable to permit at least one of (a) inflation thereof; and (b) deflation thereof. In yet another feature, the outer membrane is thicker than the inner membrane and defines a scuff resistant outer surface of the container; and (b) the inner membrane has a reflective surface.

In still another feature, the container is movable between a collapsed position and a deployed position. The inflatable wall structure is self-inflating. The inflatable wall structure includes an open cell foam captured therewithin. The container has an outlet by which to permit the inflatable wall structure to be deflated, and, when the wall structure is deflated, the container is movable to a rolled-up position. The inflatable wall structure, when inflated, forms a peripheral wall having an insulated chamber defined therewithin.

These and other aspects of the invention may be more readily understood with the aid of the illustrative Figures and detailed description included hereinbelow.

BRIEF DESCRIPTION OF THE DRAWINGS

These and other aspects of the invention may be more readily understood with the aid of the illustrative Figures included herein below, and showing of an example, or examples, embodying the various aspects of the invention, provided by way of illustration, but not of limitation of the present invention, and in which.

DETAILED DESCRIPTION

Figure 1A:
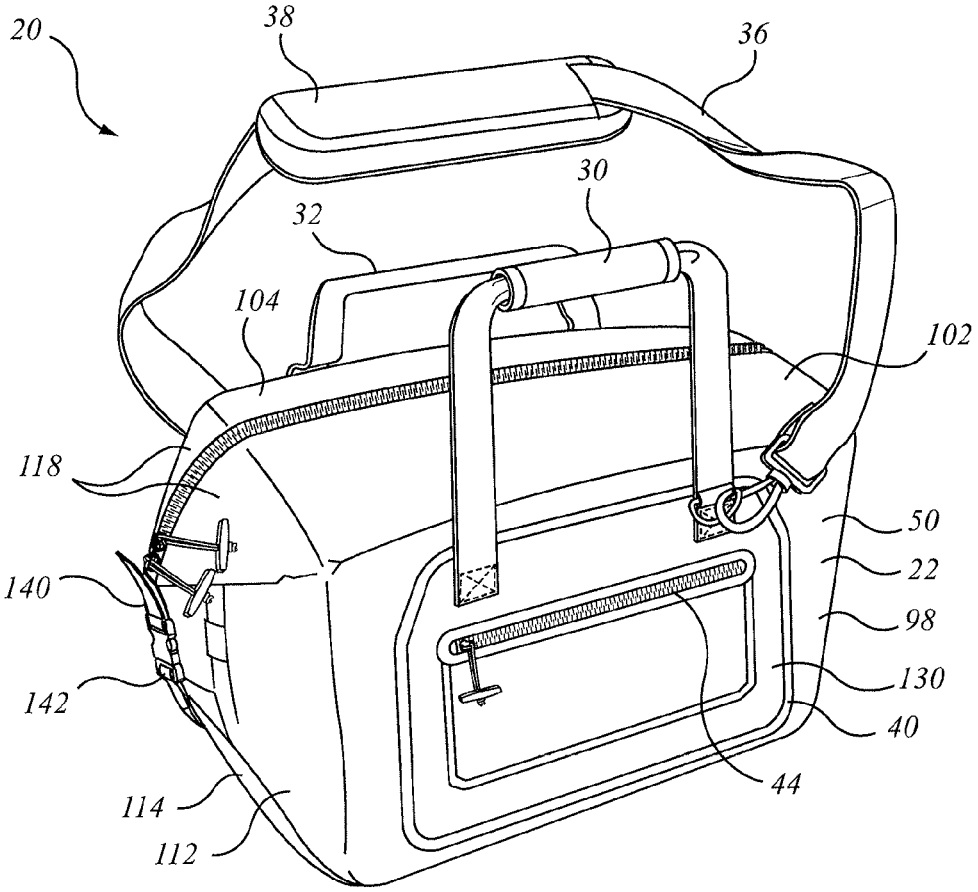
FIG. 1*a* shows a perspective view from the front, to one side and above, of an example of an embodiment of a soft-sided insulated container according to an aspect of the invention herein in a deployed and closed condition.

The description that follows, and the embodiments described therein, are provided by way of illustration of an example, or examples, of particular embodiments of the principles, aspects and features of the present invention. These examples are provided for the purposes of explanation, and not of limitation, of those principles, aspects, and features of the invention. In the description, like parts are marked throughout the specification and the drawings with the same respective reference numerals. The drawings are not necessarily to scale and in some instances proportions may have been exaggerated in order more clearly to depict certain features of the invention.

For the purposes of this description, the insulated containers herein may be termed "coolers", as a convenient shorthand. For the purposes of this description, it may be that a Cartesian frame of reference may be employed. In such a frame of reference, the long, or largest dimension of an object may be considered to extend in the direction of the x-axis, the base of the article, where substantially planar, may be considered to extend in an x-y plane, and the height of the article may be measured in the vertical, or z-direction. The largest panels of the containers described herein may be designated arbitrarily as the front and rear sides, faces, or portions of the container. Similarly, the closure member, or opening of the bag is arbitrarily designated as being at the top, and the base panel is designated as being at the bottom, as these terms may be appropriate for the customary orientation in which the objects may usually be found, sold, or used, notwithstanding that the objects may be picked up and placed on one side or another from time to time at the user's choice. Other orientations are possible, such as when carrying a pizza in a flat or generally horizontal orientation, rather than vertical. It may also be understood that, within the normal range of temperatures to which human food and human touch is accustomed, although the term cooler, or cooler container, or cooler bag, may be used, such insulated structures may generally also be used to keep food, beverages, or other objects either warm or hot as well as cool, cold, or frozen.

In this specification reference is made to insulated containers. The adjective "insulated" is intended to be given its usual and normal meaning as understood by persons skilled in the art. It is not intended to encompass single layers, or skins, of conventional webbing materials, such as Nylon™, woven polyester, canvas, cotton, burlap, leather, paper and so on, that are not otherwise indicated as having, or being relied upon to have, particular properties as effective thermal insulators other than in the context of being provided with heat transfer resistant materials or features beyond that of the ordinary sheet materials in and of themselves. Following from Phillips v. AWH Corp., this definition provided in the specification is intended to supplant any dictionary definition, and to prevent interpretation in the US Patent Office (or in any other Patent Office) that strays from the customary and ordinary meaning of the term "insulated" as provided herein.

Similarly, this description may tend to discuss various embodiments of soft-sided wall members, as opposed to hard shell or hard-sided containers. In the jargon of the trade, a soft-sided cooler, or container, is one that does not have a substantially rigid, high density exoskeleton (typically a molded shell, e.g., of ABS or polyethylene, or other common types of molded plastic). Rather, a soft-sided wall may tend to have, for example, an outer skin, a layer of insulation, and an internal skin, both the internal and external skins being of some kind of webbing, be it a woven fabric, a nylon sheet, or some other membrane. The layer of insulation, which may be a sandwich of various components, is typically a flexible or resilient layer, perhaps of a relatively soft and flexible foam. A soft-sided container may still be a soft-sided container where, as described herein, it may include a substantially rigid liner, or may include one or more battens (which may be of a relatively hard plastic) concealed within the soft sided wall structure more generally, or where hard molded fittings may be used either at a container rim or lip, or to provided a base or a mounting point for wheels, but where the outside of the assembly is predominantly of soft-sided panels. Again, this definition is intended to forestall the US Patent Office, (or any other Patent Offices), from adopting an interpretation of the term "soft-sided" that diverges from the ordinary and customary meaning of the term as understood by persons of ordinary skill in the art in the industry, and as explained herein.

Figure 1B:
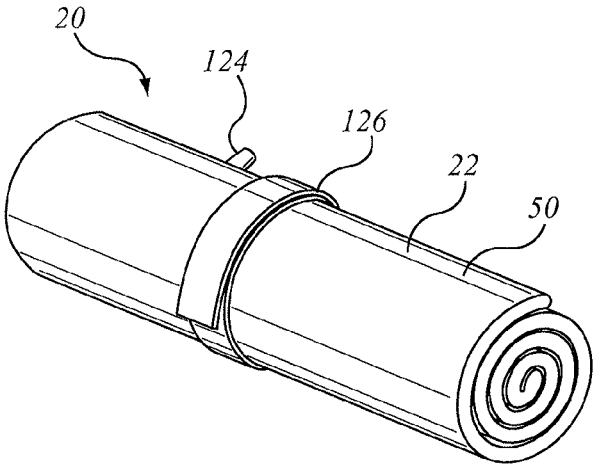
FIG. 1*b* shows a perspective view of the soft-sided, insulated container of FIG. 1*a* in a deflated, collapsed, and rolled-up condition.
Figure 1C:
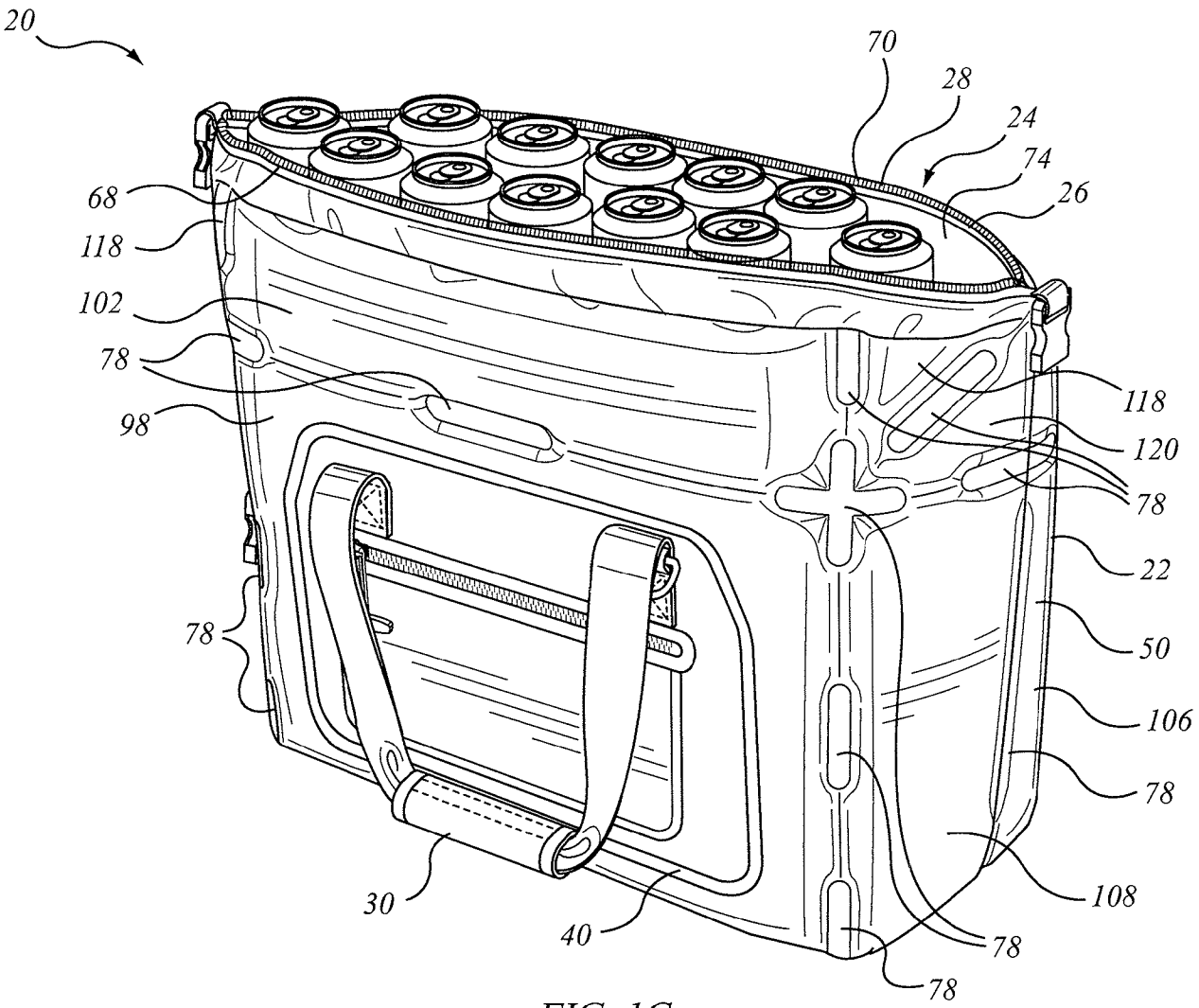
FIG. 1*c* shows a perspective view of the container of FIG. 1*a* in tote bag form, filled.
Figure 1D:
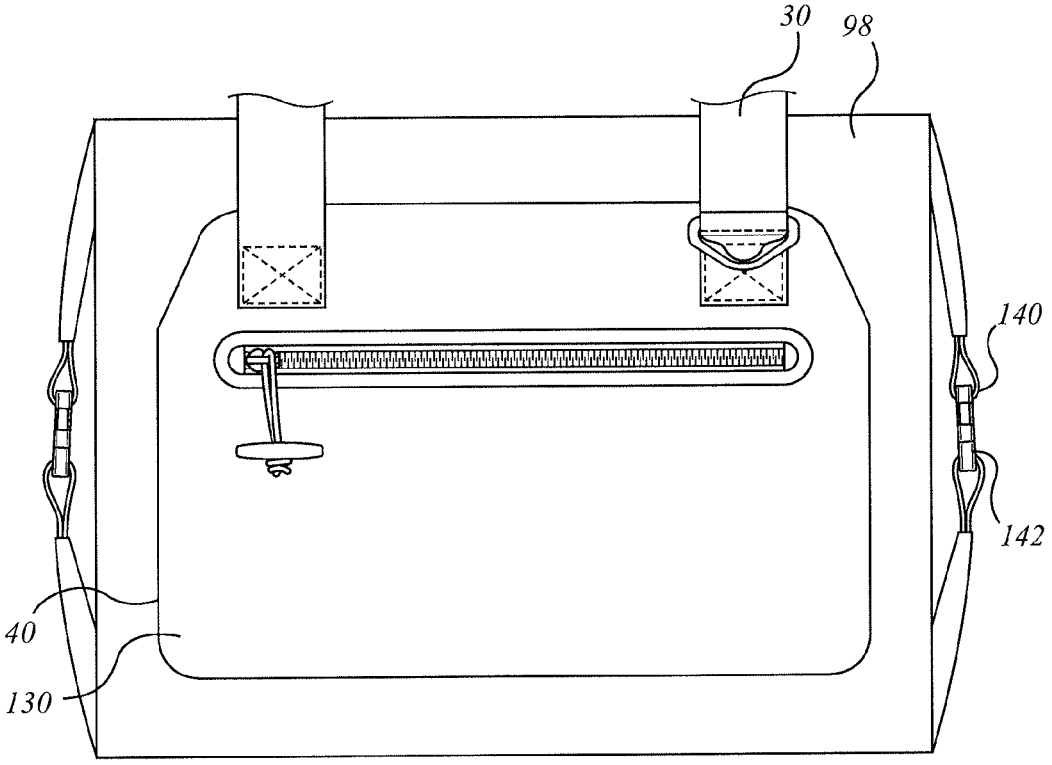
FIG. 1*d* is a front view of the container of FIG. 1*a;*

FIGS. 1*a* to 1*c* show a soft-sided insulated container or container assembly, indicated generally as 20. It has a soft-sided, insulated wall structure, identified as 22, that defines a peripheral wall enclosing an internal chamber, generally indicated as 24. Access to the interior of chamber 24 is controlled be an access governor such as may be termed a closure member. Closure member 26 may be a tracked fastener such as a zipper 28. The assembly may have handles 30, 32 by which it may be lifted, and it may include a handle cinch or securement member, such as pad 34 which, in use, wraps around the bails of both handles 30, 32 to facilitate their carriage in one hand. A shoulder strap 36 with load spreading shoulder pad 38 may also be provided. External patches, or sheets, or pads 40, 42 may be added, or mounted to wall structure 22, and may include pouches or pockets 44, in which documents or other objects may be received.

Figure 2A:
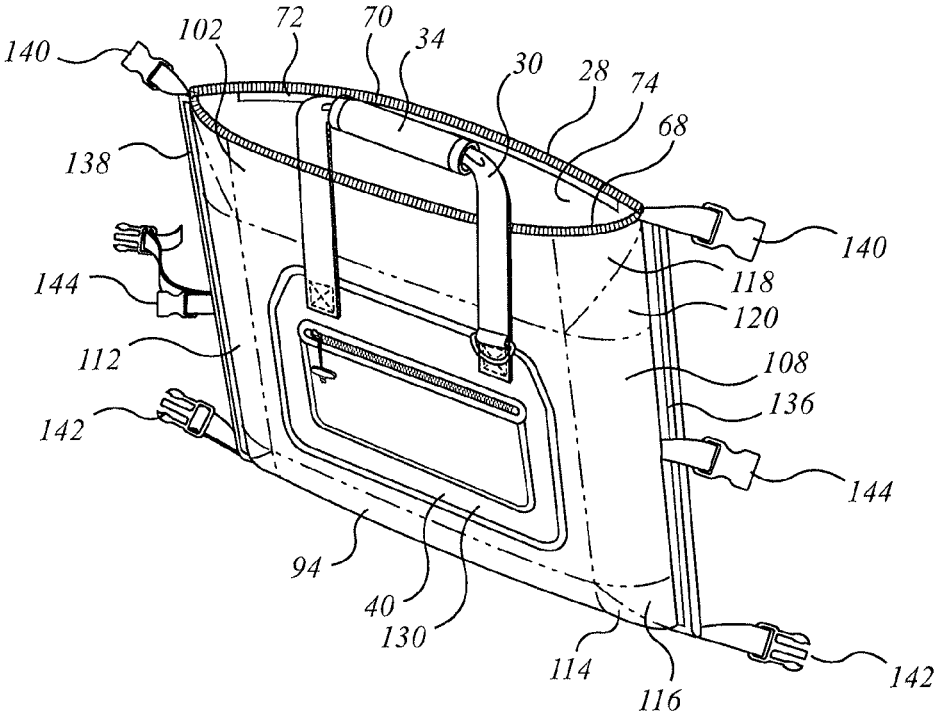
FIG. 2*a* shows a perspective view of the container of FIG. 1*a* in a tote-bag configuration, empty, with the top closure member open.
Figure 2B:
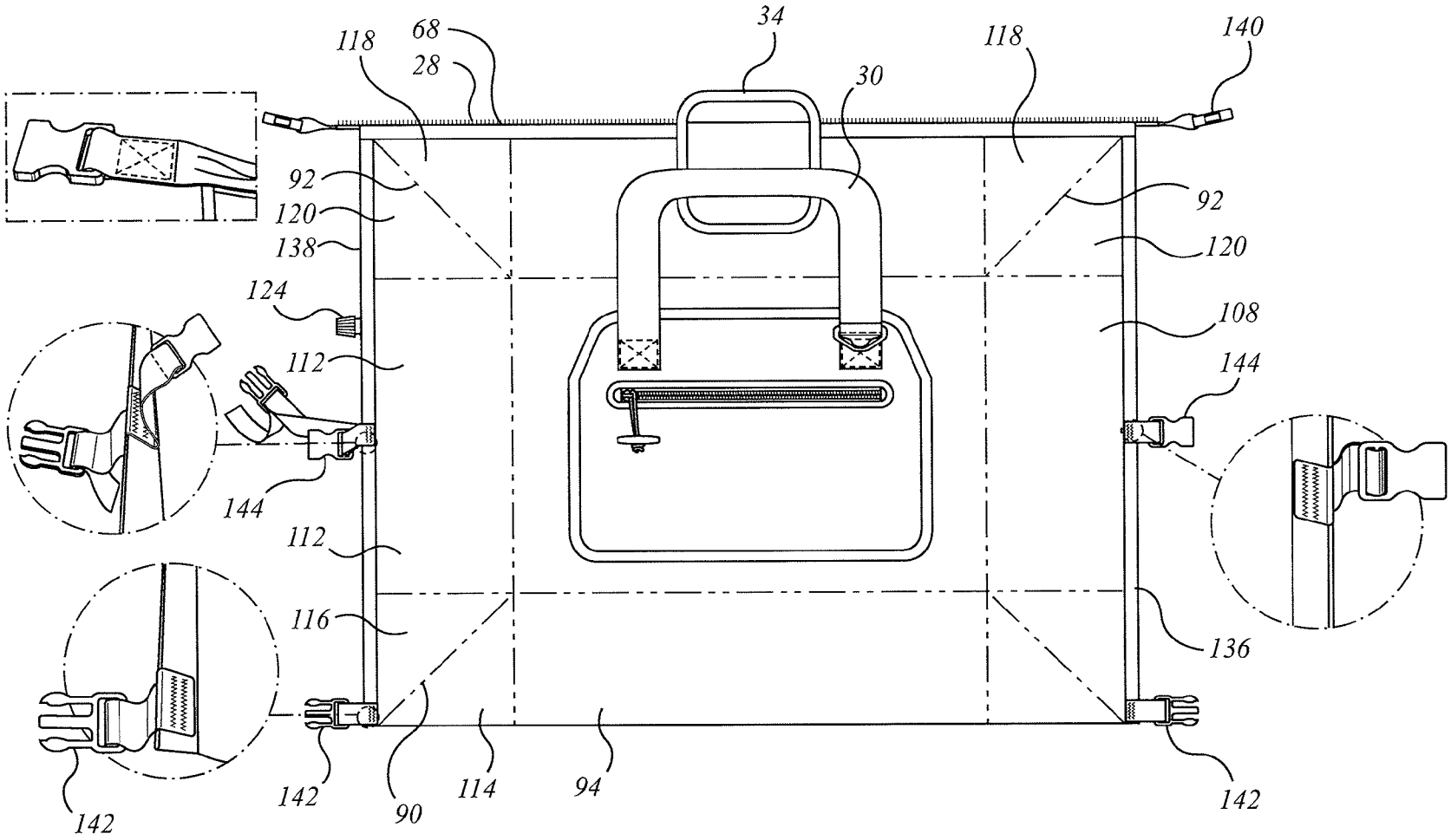
FIG. 2*b* is a front view of the container of FIG. 2*a;*

As may be noted, container 20 may be deployed as a generally box-shaped container, as in FIG. 1*a*, or as a tote-bag shaped container as in FIGS. 1*c*, 2*a*, or 2*b*, or it may be collapsed and rolled up as in FIG. 1*b*.

Figure 3A:
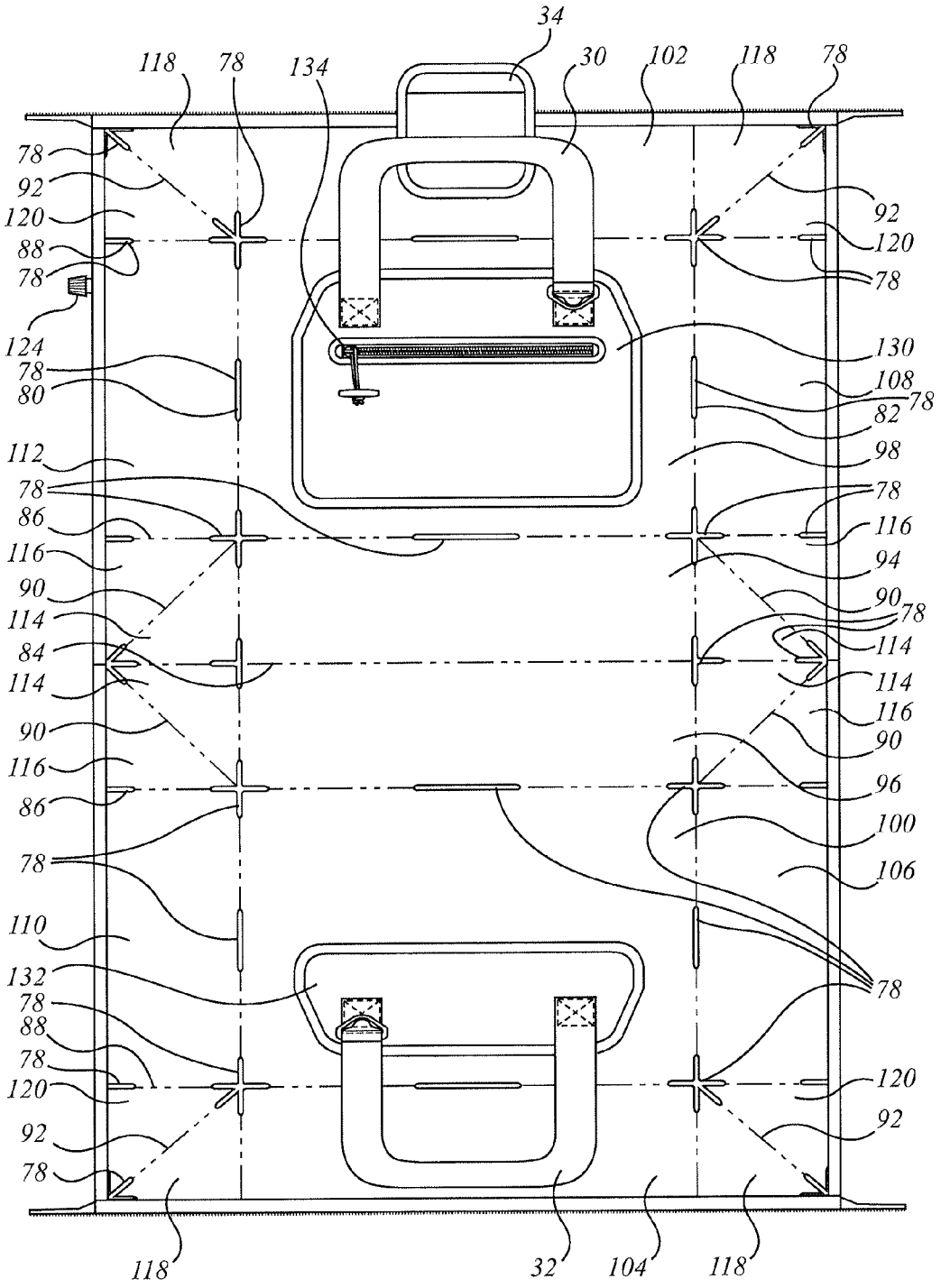
FIG. 3*a* shows a developed view of the container of FIG. 2*a* during manufacture.
Figure 3D:
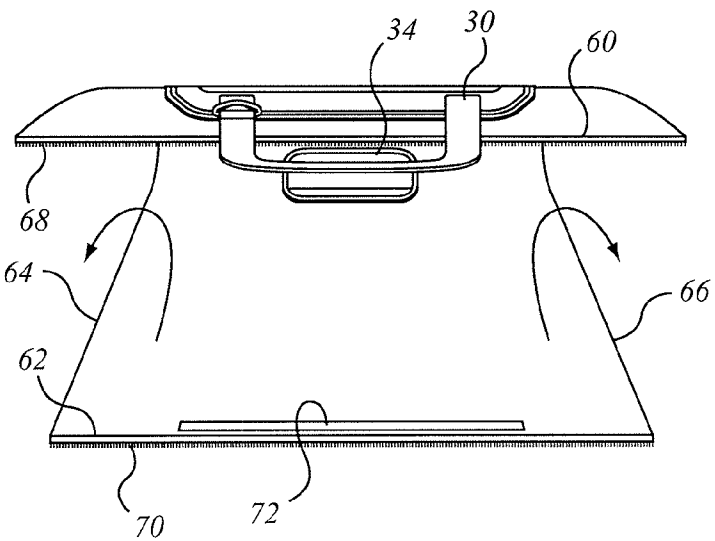
FIG. 3*d* is a conceptual view showing the container of FIG. 3*a* being folded during manufacture.
Figure 3B:
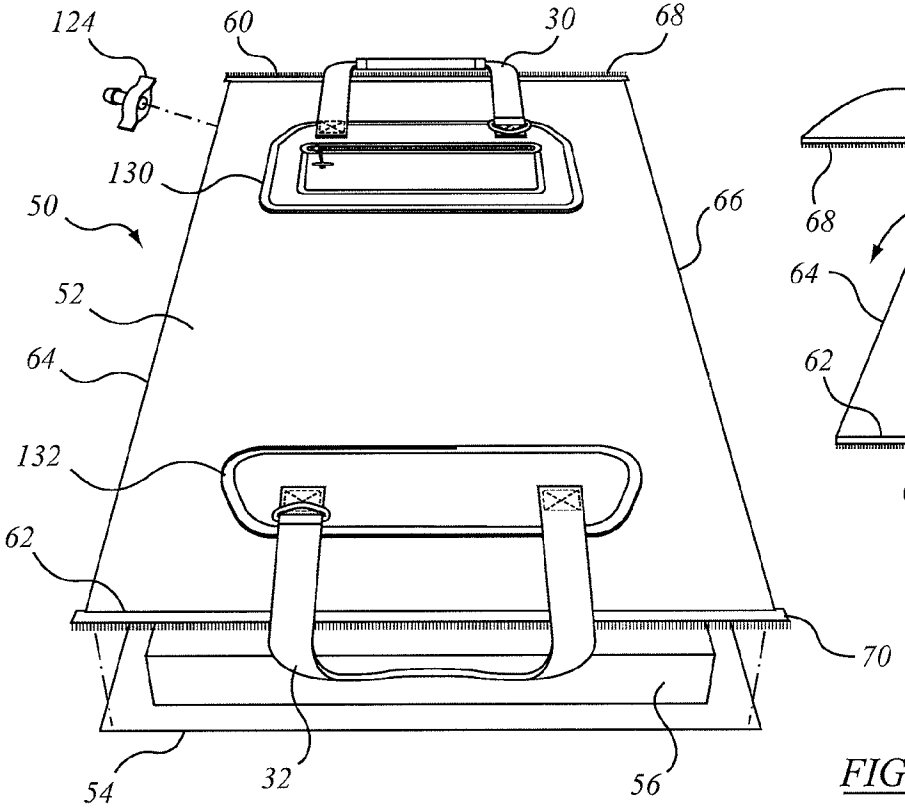
FIG. 3*b* is an exploded end perspective view of the container of FIG. 3*a;*
Figure 3C:
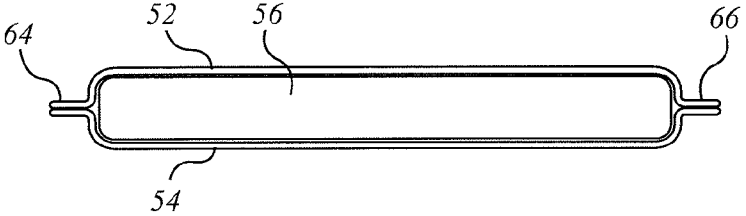
FIG. 3*c* is a cross-sectional view of the container of FIG. 3*a;*

The structure of container 2*c* may be understood with reference to FIGS. 3*a*, 3*b*, 3*c* and 3*d*. In FIG. 3*b*, it can be seen that the wall structure assembly section indicated as 50 includes a first membrane or sheet 52, a second membrane or sheet 54 and a layer of insulation material 56. First sheet 52 may be designated as the inside skin. Sheet 54 may similarly be designated the outside skin. In each case, sheets 52 and 54 may be made of an air impermeable flexible sheet material, be it a rubberized material or some other. In one embodiment it may be an high denier nylon material that has been impregnated or coated, inside and out, with a thermoplastic urethane. In one embodiment, inside sheet 52 may have a shiny surface, such as a metallic reflective surface, that faces into chamber. In other embodiments inside may not be reflective. Outside sheet 54 may be thicker than inside sheet 52. It may be roughly one and a half to two and a half times as thick, and may be made of, or include, an outer scuff-resistant skin or surface, such as may tend to resist punctures.

Insulation material 56 is, or includes, resilient material with a memory, such that although it may be compressed to a smaller size, such that the air is squeezed out of it, the material will tend to return to its previous shape when released. The tendency to return to the original shape may tend to result in a self-inflating ability. Material 56 may be an open-cell air-porous foam. Material 56 may be a material other than an open-celled foam. Although it is convenient that a single sheet of insulation material be used, several smaller sheets could also be used.

Sheets 52 and 54 are of generally corresponding extent, that extent being greater than the extent of insulation material 56, such that the peripheries of sheets 52 and 54 may be sealed together, whether by bonding or welding to form an air impermeable seal. The width of the sealed zone, or weldment, may be quite substantial, being of the order of one half of an inch to one inch. To the extent that sheets 52 and 54 are generally rectangular. The edges may be identified as a first end edge 60, a second, opposed edge 62, a first side edge 64 and a second side edge 66. Mating left and right hand guided fastener tracks, i.e., zipper tracks 68, 70 of zipper 28.

The inside face defined by sheet 52 may be substantially unobstructed, other than for the inclusion of fastening or securement fittings, such as fabric hook and eye strips 72

(e.g., Velcro™) mounted by adhesive bonding to the weldment strips immediately adjacent to first and second, or left and right hand zipper tracks 68, 70 of zipper 28. These securement fittings may be used as releasable securements for mating fittings of like nature of a removable, washable liner 74. Liner 74 may be transparent, and may be a seamless liner. In other embodiment, liner 74 may be permanently fixed in place, and in still other embodiments container 20 may have neither strips 72 nor liner 74.

Considering again FIG. 3*a*, weldments 78 are also made at various locations at which assembly 50 is intended to be foldable. The various folds permit assembly 50 to be positioned in the tote bag configuration of FIGS. 1*c*, 2*a*, and 2*b*; and also in the box-shaped configuration of FIG. 1*a*. There are two longitudinal folds 80, 82 that divide assembly 50 into left and right hand margins and a central portion. There are lateral folds, proceeding outwardly from the main centerline fold 84, bottom main face fold 86, and top marginal fold 88. There are also diagonal lower and upper corner folds 90 and 92, respectively. Assembly 50 is thus divided into first and second bottom half portions 94, 96; first and second, or front and rear, main panel portions 98, 100; first and second upper panel portions 102, 104, first and second, left and right hand end panel halves 106, 108, 110 and 112. There are also inner and outer bottom folding gusset portions 114, 116, and first and second top corner folding gusset portions 118, 120.

A valve, or valve assembly 124 may be welded in place along one of the side margins of assembly 50, as indicated. Valve assembly 124 is a governor that controls, i.e., blocks or permits, flow of air into or out of assembly 50. When rolled up, as in FIG. 1*b*, valve assembly 124 is open to allow air to be expelled during the collapsing and rolling up, and closed thereafter to keep air out. When rolled up, container 20 may be retained in the rolled condition by a strap 126, such as may have mating hook-and-eye fabric fastener portions. When the strap is released, valve assembly 124 is opened, and the resiliency of the open celled foam material tends to spread inner and outer sheets 42 and 44 away from each other increasing the volume captured between them and, consequently drawing air into that space.

External shear panels, doublers, or pads, or mountings 130, 132 are attached to the main front and rear panel portions 98, 100 respectively, and function as load distributing anchors of handles 30, 32. That is, the ends of the straps of handles 30, 32 may be attached, as by sewing or other means to mountings 130, 132, which may themselves be attached to portions 98, 100. Attachment is by non-puncturing means, such as by adhesive bonding or by a thermal bonding process such as welding or vulcanizing. Auxiliary compartment members, such as pockets or pouches 134 may be attached externally to mountings 130, 132.

When the external fittings have been mounted to assembly 50, it is then folded, as suggested by FIG. 3*d*, and the side edges bonded together, again as by bonding or by a thermal process such as welding at left and right hand main seams 136 and 138.

Upper and lower quick release fittings 140, 142 may be mounted at the zipper ends and at the points formed where the bottom gussets fold. In the tote-bag configuration of FIGS. 1*c*, 2*a* and 2*b*, fittings 140, 142 are not connected. However, when container 20 is used in the more box-shaped configuration of FIG. 1*a*, the clips or clasps are joined, the effect being to fold down (and up) the end flaps, much as when folding wrapping paper, the securement of the ends tending to hold the package in its box-shaped form. Alternatively, container 20 may also have intermediate level quick-release fittings 144, such as may engage with lower fittings 142. In this embodiment the lower portion of container 20 may have a box shape, while the upper portion remains like the tote bag shape.

In the box-shaped configuration, the first and second bottom half portions 94 and 96 define a generally flat bottom; first and second left hand end panel halves 106, 108 (which are joined at left hand main seam 136) form the left hand end panel; first and second right hand end panel halves 110, 112 (which are joined at right hand main seam 138). The front and rear (or first and second) main side panels are defined by panel portions 98 and 100 respectively; the top wall is defined by first and second upper panel portions 102, 104 joined by zipper 28 in a generally flat panel. In this configuration the top corner panel gusset 120 folds under gusset 118, such that a triangular central point is formed at which fitting 140 is mounted. Similarly, each gusset 116 folds under its associate gusset 114, forming a central point at which fitting 142 is mounted, the whole point then being pulled to lie upwardly, adjacent to the respective end wall.

In the tote-bag configuration, all of the portions to one side of main central fold 84 form one side of a tote pouch, while all of the portions to the other side form the other side of the tote. As the pouch is filled, the sides bulge accordingly.

Although container 20 has been shown and described as having a single communicating space into which air may be introduced or expelled, and thus only a single valve, the apparatus could have more than one valve—such as an inlet valve and an outlet valve. Alternatively it could have more than one valve that is both an inlet and an outlet valve to allow faster or easier inflation and deflation. In another embodiment, the compressible substance may merely be vented, or portions of the external skin may "breathe", in either case without the use of a valve. It is not necessary that all sides of the container assembly be inflatable wall panels. For example, it may be desired that the bottom panel of the apparatus (corresponding to items 94 and 96) such as may rest on sharp objects on the ground, and such as may be especially prone to damage or abuse, may be made of a non-inflating panel, or panels, such as substantially solid UHMW polymer. Alternatively, too, it may be that only a subset of panels is inflatable, such as main side panel portions 98 and 100. It that case, each of those panels may be separately inflatable, or they may be in fluid communication. In one embodiment, container 20 is buoyant, such that if it falls in the water it will float even when rolled-up. In another embodiment, given the buoyancy of wall structure 22, container 20 will float when deployed and empty.

The principles of the present invention are not limited to these specific examples which are given by way of illustration. It is possible to make other embodiments that employ the principles of the invention and that fall within its spirit and scope of the invention. Since changes in and or additions to the above-described embodiments may be made without departing from the nature, spirit or scope of the invention, the invention is not to be limited to those details, but only by the appended claims.

We claim:

1. A soft-sided insulated container having an inflatable wall structure, said inflatable wall structure being self-inflating;

said container is movable between a collapsed position and a deployed position;

said inflatable wall structure in said deployed position being selectable between (a) a tote-shaped container configuration and (b) a cubic container configuration;

said inflatable wall structure, when inflated, forms a peripheral wall having an insulated chamber defined therewithin in which to place objects;

said inflatable wall structure has an outer membrane, an inner membrane, and a layer of insulation trapped between said outer membrane and said inner membrane;

said layer of insulation includes an open cell foam captured between said outer membrane and said inner membrane;

said container has an outlet by which to permit said inflatable wall structure to be deflated, and, when said wall structure is deflated, said container is movable to said collapsed position, said collapsed position being a rolled-up position.

2. The soft-sided insulated container of claim 1 wherein at least one of:

(a) said outer membrane is thicker than said inner membrane and defines a scuff resistant outer surface of said container; and (b) said inner membrane has a reflective surface.

3. A soft-sided insulated container having:

a self-inflating wall structure;

said self-inflating wall structure having inner and outer skins and a resilient insulating member mounted between the inner and outer skins, said wall structure having weldments at an array of fold locations;

said wall structure defining a chamber therewithin and having a closure member governing access to said chamber;

said array of fold locations defining a plurality of panels of said soft-sided insulated container;

said plurality of panels including a first main panel;

said first main panel having a first load spreader doubler mounted to said outer skin thereof and extending away from said closure member; and there being a first handle mounted amidst said doubler.

4. The soft-sided insulated container of claim 3 wherein said load spreader doubler is mounted externally to said outer skin of said first main panel, and said first main panel is free of penetrations at said load spreader doubler.

5. The soft-sided insulated container of claim 3 wherein said container includes a second main panel opposed to said first main panel; and said second main panel has a second load spreader doubler and second handle mounted thereto in opposition to said first handle.

6. A soft-sided insulated container having:

a self-inflating wall structure;

said wall structure having inner and outer skins and a resilient insulating member mounted between the inner and outer skins, said wall structure having weldments at an array of fold locations; and said fold locations defining alternate configurations of said wall structure when inflated;

said alternate configurations including a first configuration and a second configuration.

7. The soft-sided insulated container of claim 6 wherein said first configuration is a tote bag configuration, and said second configuration is box-shaped.

8. The soft-sided insulated container of claim 7 wherein said container has a releasable securement operable to maintain said container in the selected one of said alternate configurations when said inflatable wall structure is inflated.

9. The soft-sided insulated container of claim 8 wherein said first securement is connected to a weldment of the inner and outer skins.

10. The soft-sided insulated container of claim 6 wherein said array of fold locations define a plurality of sub-regions of said container wall structure, said plurality of sub-regions being in communication, and said plurality of sub-regions in communication share a single valve at which to introduce air.

11. The soft-sided insulated container of claim 6 wherein said array of fold locations defines a first main panel, said first main panel has a load distributor mounted thereto, and a handle mounted to said load distributor amidst said first main panel.

12. The soft sided insulated container of claim 11 wherein said load distributor is a doubler welded to said outer skin, and said handle is mounted amidst said doubler.

13. The soft-sided insulated container of claim 6 wherein:

said array of fold locations defines a first main panel and an opposed second main panel;

a first load distributor is mounted to said first main panel;

a second load distributor is mounted to said second main panel;

a first handle is secured to said first load distributor;

a second handle is secured to said second load distributor; and in use said first and second handles are mounted on opposite sides of said container.

14. The soft-sided insulated container of claim 13 wherein:

said first and second load distributors are doublers mounted to said first and second panels respectively; and said first and second handles are secured amidst said first and second doublers, respectively.

15. The soft-sided insulated container of claim 6 wherein said structure includes a first portion in which a peripheral seal is made between said inner and outer skins, and said wall structure has a weldment at a first pre-fold location that is spaced inwardly and away from said peripheral seal.

16. The soft-sided insulated container of claim 6 wherein, when uninflated, said soft-sided container is rollable into a collapsed condition.

17. The soft sided insulated container of claim 6 wherein:

said container has a closure at which a first margin and a second margin of said wall structure meet releasably;

said closure has a first end;

said container has a portion distant from said first and second margins;

said container has a releasable securement connected to link said first end of said closure to said distant portion of said container, whereby to secure said container in said first configuration.

18. The soft sided insulated container of claim 6 wherein:

said first configuration is a box-shaped configuration;

said second configuration is a tote-bag shaped configuration;

said container has a closure at which a first margin and a second margin of said wall structure meet releasably, said closure defining a top location of said container;

said container has a region distant from said first and second margins, said distant region defining a bottom location of said container;

said closure has a first end and a second end;

said distant region has a first end and a second end;

a first releasable fastener is mounted releasably to link said first end of said closure to said first end of said distant region;

a second releasable fastener is mounted releasably to link said second end of said closure to said second end of claim distant region; and when connected, said first and second releasable fasteners retaining said container in said box-shaped configuration.

19. The soft-sided insulated container of claim 6 wherein:

said outer skin and said inner skin are of corresponding extent;

said resilient insulation member has an extent that is less than the extent of the inner and outer skins;

said inner and outer skins being peripherally sealed to each other with said resilient insulation member being captured therebetween;

said fold locations are defined by weldments of said inner skin to said outer skin;

said fold locations dividing said wall structure into a plurality of panels;

said plurality of panels including a bottom panel, a first main panel, a second main panel opposed to said first main panel, a first end panel and a second end panel;

said bottom panel, first and second main panels, and end panels being in communication to permit common inflation thereof.

20. The soft-sided insulated container of claim 6 wherein:

said first configuration is a tote-bag configuration;

said second configuration is a box-shaped configuration;

said outer skin and said inner skin are of corresponding extent;

said resilient insulation member has an extent that is less than the extent of the inner and outer skins;

said inner and outer skins being peripherally sealed to each other with said resilient insulation member being captured therebetween;

said resilient insulation member including an open-celled foam;

said fold locations are defined by weldments;

said fold locations include weldments located to define a central fold;

said wall structure having first and second margins distant from said central fold, said first and second margins having mating portions of a closure member mounted therealong;

said fold locations dividing said wall structure into a plurality of panels;

said plurality of panels including first and second bottom panels to either side of said central fold, a first main panel, a second main panel opposed to said first main panel, a first right-hand end panel and a first left-hand end panel, and a second right-hand end panel and a second left-hand end panel;

said bottom panels, first and second main panels, and right hand and left-hand end panels being in communication to permit common inflation thereof from a single valve;

said first and second main panels having doublers mounted thereto, and handles mounted amidst said doublers; and releasable securements mounted at first and second ends of said closure member, said securements being operable in one position to retain said wall structure in said second configuration.

* * * * *